US008493423B2

(12) United States Patent
Aso et al.

(10) Patent No.: US 8,493,423 B2
(45) Date of Patent: Jul. 23, 2013

(54) THERMAL RECORDING HEAD AND THERMAL RECORDING APPARATUS COMPRISING THE SAME

(75) Inventors: Takashi Aso, Kirishima (JP); Makoto Miyamoto, Okaya (JP)

(73) Assignee: Kyocera Corporation, Kyoto (JP)

( * ) Notice: Subject to any disclaimer, the term of this patent is extended or adjusted under 35 U.S.C. 154(b) by 147 days.

(21) Appl. No.: 13/146,621

(22) PCT Filed: Jan. 27, 2010

(86) PCT No.: PCT/JP2010/051009

§ 371 (c)(1), (2), (4) Date: Jul. 27, 2011

(87) PCT Pub. No.: WO2010/087355

PCT Pub. Date: Aug. 5, 2010

(65) Prior Publication Data

US 2011/0285803 A1 Nov. 24, 2011

(30) Foreign Application Priority Data

Jan. 28, 2009 (JP) ..... 2009-016526

(51) Int. Cl.
*B41J 2/335* (2006.01)

(52) U.S. Cl.
USPC ..... 347/208; 347/209

(58) Field of Classification Search
USPC ..... 347/200, 201, 202, 206, 208, 210, 347/211
See application file for complete search history.

(56) References Cited

U.S. PATENT DOCUMENTS 6,467,863 B1 * 10/2002 Imanaka et al. ..... 347/9
6,631,970 B2 * 10/2003 Sato et al. ..... 347/19
(Continued)

FOREIGN PATENT DOCUMENTS

CN 1277110 A 12/2000
JP 06305168 A 11/1994
(Continued)

OTHER PUBLICATIONS

Chinese language office action dated May 2, 2013 and its English language statement of relevance issued in corresponding Chinese application 201080004851.3 cites the foreign patent documents listed above.

*Primary Examiner* — Huan Tran
(74) *Attorney, Agent, or Firm* — DLA Piper LLP (US)

(57) ABSTRACT

[Problem] There are provided a thermal recording head capable of making proper operation of a converter, and a thermal recording apparatus including the same.

[Solution] A thermal recording head (10) of the invention is driven on a basis of a first control signal and includes a head substrate (20) including heat generating elements (23*a*), a wiring substrate (30) including, on its surface, a wiring pattern (312) for transmission of the first control signal, and a mount substrate (40) disposed facing a back surface of the head substrate (20) and a back surface of the wiring substrate (30) and configured to mount the head substrate (20) and the wiring substrate (30). On the surface of the head substrate (20) is placed a control element (27) electrically connected to the heat generating elements (23*a*) and configured to control driving of the heat generating elements (23*a*). On the surface of the wiring substrate (30) is placed a converter (323) electrically connected to the wiring pattern (312) and configured to convert the first control signal into a second control signal. The mount substrate (41) is spaced away from a corresponding region at the back surface of the wiring substrate (30) that corresponds to a fourth placement area (40*d*) bearing the converter (323) on the surface of the wiring substrate (30).

7 Claims, 18 Drawing Sheets

U.S. PATENT DOCUMENTS

| | | | | |
|---|---|---|---|---|
| 6,652,053 | B2 * | 11/2003 | Imanaka et al. | 347/7 |
| 2002/0021315 | A1 | 2/2002 | Sato et al. | |

FOREIGN PATENT DOCUMENTS

| | | | |
|---|---|---|---|
| JP | 08300702 | A | 11/1996 |
| JP | 2006-119215 | | 5/2006 |
| JP | 2006319145 | A | 11/2006 |
| JP | 2007-301722 | | 11/2007 |
| JP | 2009006638 | A | 1/2009 |

* cited by examiner

THERMAL RECORDING HEAD AND THERMAL RECORDING APPARATUS COMPRISING THE SAME

CROSS-REFERENCE TO THE RELATED APPLICATIONS

This application is a national stage of international application No. PCT/JP2010/051009, filed on Jan. 27, 2010, which also claims the benefit of priority under 35 USC 119 to Japanese Patent Application No. 2009-016526, filed on Jan, 28, 2009, the entire contents of which are incorporated herein by reference.

TECHNICAL FIELD

The present invention relates to a thermal recording head having a converter configured to convert a signal which is involved in driving of a heat generating element, as well as to a thermal recording apparatus comprising the thermal recording head.

BACKGROUND ART

As an example of printers for a facsimile, a register, and so forth, there has been used a thermal printer provided with a thermal head and a platen roller, for performing printing on a recording medium such as heat-sensitive paper, a thermal transfer ink ribbon, or plain paper. As a thermal head mounted in such a thermal printer, there is known the one having a plurality of heat generating elements arranged on a head substrate and a control element disposed on the head substrate, for controlling the driving of the heat generating element. The platen roller has the function of pressing a recording medium such for example as heat-sensitive paper against the heat generating elements. In the thermal printer thus constructed, the heat generating elements are caused to generate heat in accordance with a desired image, and a recording medium is pressed against the heat generating elements by the platen roller. In this way, heat generated by the heat generating element can be transmitted satisfactorily to the recording medium. With the repetition of such process steps, the desired image can be printed onto the recording medium.

Some thermal heads of this type are installed with a thermistor configured to detect thermal head temperature. An example thereof is disclosed in Patent literature 1. In the case of conducting temperature detection with such a thermistor, there is used a detector configured to detect variation in resistance value of the thermistor as variation in the magnitude of voltage or electric current. In this case, however, the influence of noise becomes more significant with an increase in the distance of signal transmission. In this regard, in the case where the detector is mounted on the head substrate to achieve a decrease in the transmission distance, the possibility arises that, due to heat generated by the heat generating element, the rated junction temperature of a semiconductor device inside the detector will be exceeded with a consequent operation abnormality, or that the heating/cooling temperature variation is so great that the service life will be shortened.

Such a problem associated with the influence of the transmission distance and the influence of heat generated by the heat generating element is not encountered only in the case of thermistor-based temperature detection. The problem could occur in a detector which employs a semiconductor device configured to convert a signal which is involved directly or indirectly in driving of the heat generating element.

CITATION LIST

Patent Literature

Patent literature 1: Japanese Unexamined Patent Publication JP-A 2006-119215

SUMMARY OF INVENTION

Technical Problem

The invention has been devised in view of the circumstances as mentioned above, and accordingly an object of the invention is to provide a thermal recording head capable of making proper operation of a converter, and a thermal recording apparatus comprising the thermal recording head.

Solution to Problem

A thermal recording head according to the invention is a thermal recording head constituted to be driven on a basis of a first control signal and comprises: a head substrate comprising a substrate and a plurality of heat generating elements arranged on a surface of the substrate; a wiring substrate comprising a wiring pattern provided on a surface of the wiring substrate; and a mount substrate disposed facing a back surface of the head substrate and a back surface of the wiring substrate and configured to mount the head substrate and the wiring substrate. On the surface of the head substrate or on the surface of the wiring substrate is placed a control element electrically connected to the heat generating elements and configured to control driving of the plurality of heat generating elements. On the surface of the wiring substrate is placed a converter electrically connected to the wiring pattern and configured to convert the first control signal into a second control signal. The mount substrate is spaced away from a corresponding region at the back surface of the wiring substrate that corresponds to a placement area bearing the converter on the surface of the wiring substrate.

In the thermal recording head according to the invention, the mount substrate may comprise a recess formed in a part thereof which faces the corresponding region of the wiring substrate. In the thermal recording head, the recess may be relative to a part of the mount substrate on which is placed the head substrate, a support plate made of a material which is lower in thermal conductivity than the mount substrate may be disposed in the recess, and the corresponding region of the wiring substrate may be located on the mount substrate, with the support plate lying between them.

In the thermal recording head according to the invention, the thermal recording head may further comprise a support plate made of a material which is lower in thermal conductivity than the mount substrate, and the corresponding region of the wiring substrate may be located on the mount substrate, with the support plate lying between them.

In the thermal recording head according to the invention, the wiring substrate may comprise a plurality of through holes arranged so as to surround the placement area.

In the thermal recording head according to the invention, the wiring substrate may comprise a first wiring substrate comprising the wiring pattern and a second wiring substrate bearing the converter, and the first wiring substrate and the second wiring substrate may be electrically connected to each other via a wiring member.

A thermal recording apparatus according to the invention comprises the thermal recording head constructed mentioned above; a conveyance mechanism configured to convey a recording medium on the heat generating elements; and a control mechanism configured to allow transmission or reception of the second control signal relative to the converter.

Advantageous Effects of Invention

According to the thermal recording head of the invention, it is possible to reduce transmission of heat generated by the heat generating elements through the mount substrate to the converter, and thereby operate the converter properly.

DESCRIPTION OF EMBODIMENTS

<First Embodiment of Thermal Recording Head>

Figure 1:
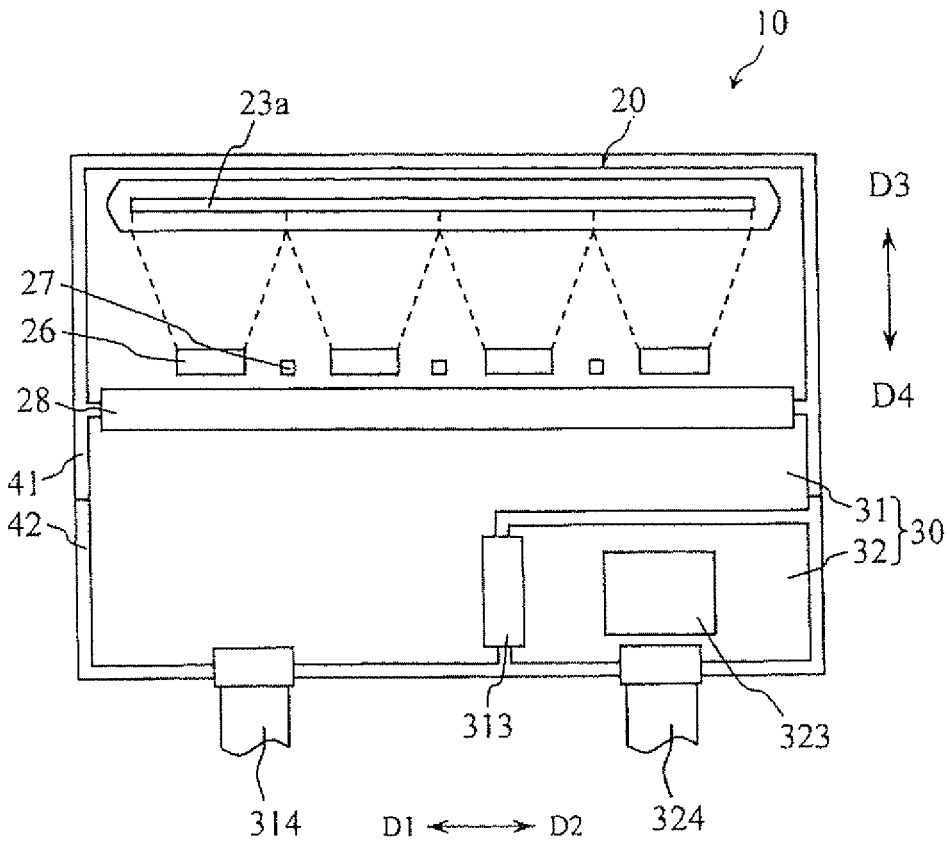
FIG. 1 is a plan view showing a schematic structure of a thermal head which is an embodiment of a thermal recording head according to the invention.
Figure 2:
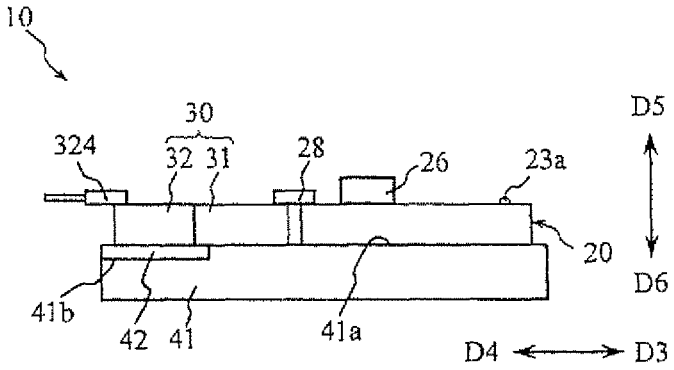
FIG. 2 is a side view of the thermal head shown in FIG. 1.

As shown in FIGS. 1 and 2, a thermal head 10 which is an embodiment of a thermal recording head according to the invention comprises a head substrate 20, a wiring substrate 30, and a mount substrate 41.

Figure 3:
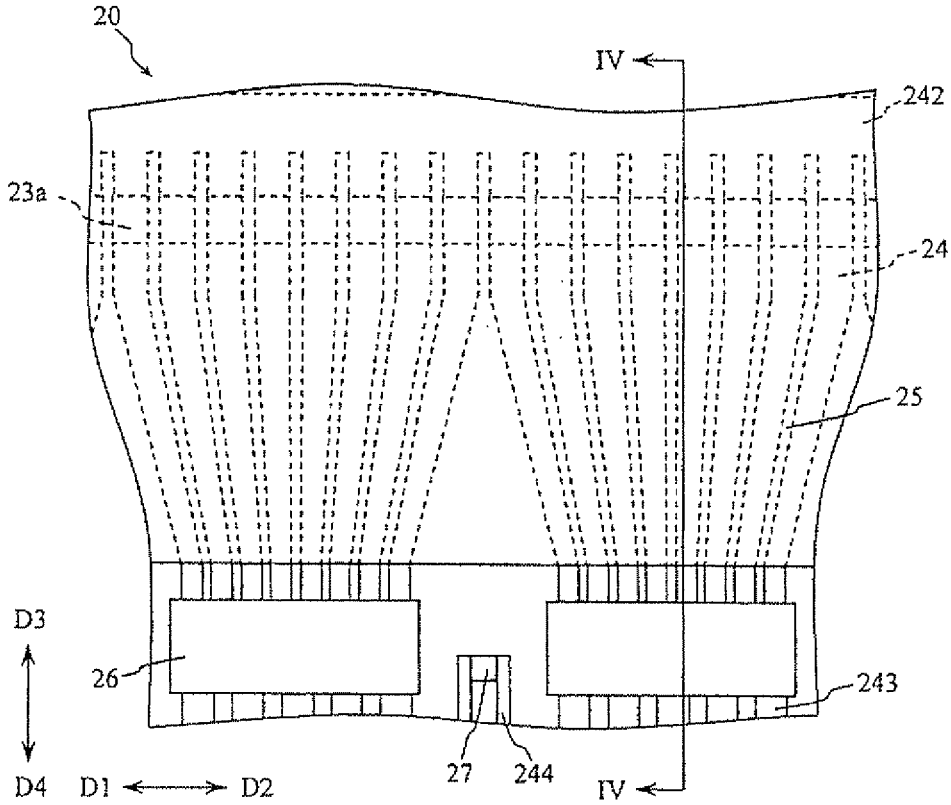
FIG. 3 is an enlarged plan view of the main part of a head substrate shown in FIG. 1.
Figure 4:
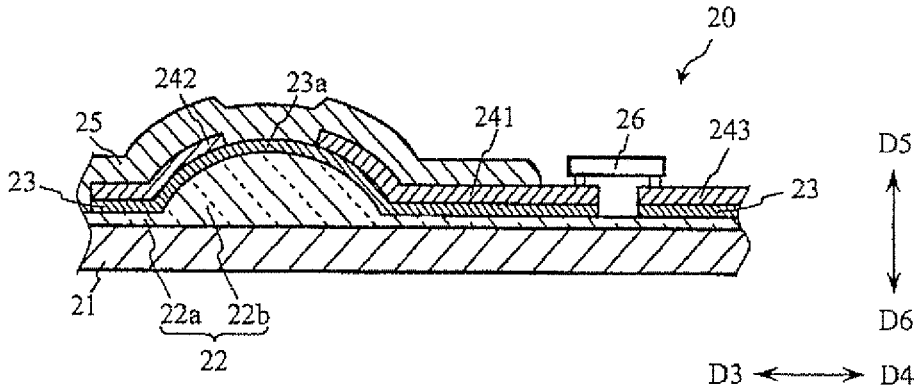
FIG. 4 is a sectional view taken along the line IV-IV shown FIG. 3.
Figure 5:
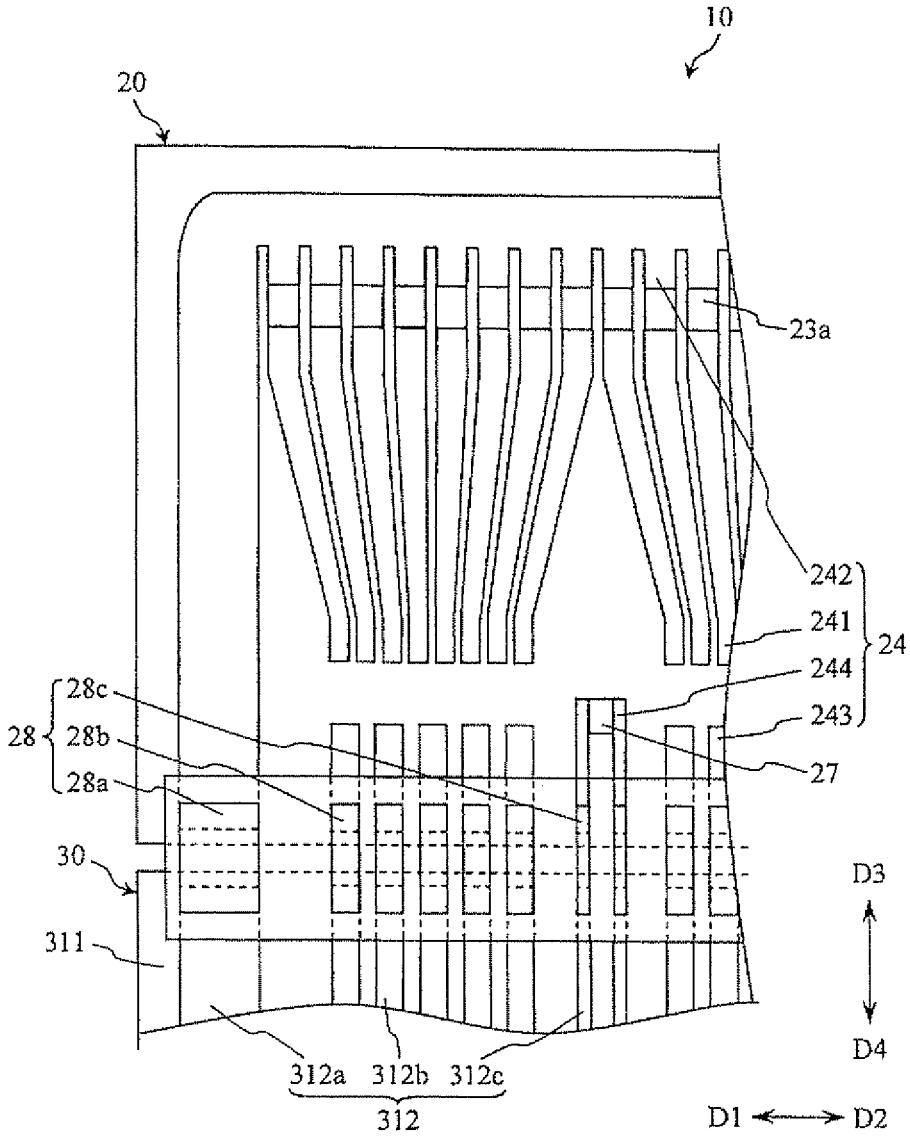
FIG. 5 is enlarged plan view of the main part of the thermal head shown in FIG. 1, with a protection layer omitted.

As shown in FIGS. 3 to 5, the head substrate 20 comprises a substrate 21, a heat storage layer 22, an electrical resistance layer 23, an electrically conductive layer 24, a protection layer 25, a control IC 26 acting as a control element, a temperature measuring element 27, and a first electrical connection member 28.

The substrate 21 has the function of supporting the heat storage layer 22, the electrical resistance layer 23, the electrically conductive layer 24, the protection layer 25, the control IC 26, and the temperature measuring element 27. When viewed in a plan view, the substrate 21 extends in main scanning directions D1 and D2 so as to define a rectangular shape. As used herein, "being viewed in a plan view" refers to being viewed in, of thickness-wise directions D5 and D6, the direction D6. Examples of the material forming the substrate 21 include ceramics, glass, silicon, and sapphire. Among these materials, glass, silicon, and sapphire are particularly desirable from the standpoint of increasing printing density. Moreover, the heat storage layer 22 is so formed as to extend over the entire upper surface of the substrate 21.

The heat storage layer 22 has the function of temporarily accumulating part of heat produced in a heat generating portion 23*a* of the electrical resistance layer 23 that will hereafter be described. That is, the heat storage layer 22 helps enhance the thermal responsive characteristic of the thermal head 10 by shortening the time required for a rise in the temperature of the heat generating portion 23*a*. The heat storage layer 22 includes a base part 22*a* and a protruding part 22*b*.

The base part 22*a* is made substantially flat so as to extend over the entire upper surface of the substrate 21.

The protruding part 22*b* is a part which is involved in pressing of a recording medium against the protection layer 25 situated on the heat generating portion 23*a* in an appropriate manner. The protruding part 22*b* is so formed as to protrude from the base part 22*a* in, of the thickness-wise directions D5 and D6, the direction D5. Moreover, the protruding part 22*b* is shaped like a strip extending in the main scanning directions D1 and D2. The protruding part 22*b* is configured to be substantially semi-elliptical in cross section as seen in sub-scanning directions D3 and D4 perpendicular to the main scanning directions D1 and D2.

The electrical resistance layer 23 has the heat generating portion 23*a* acting as a heat generating element which generates heat through supply of electric power. The electrical resistance layer 23 is so configured that an electrical resistance value per unit length thereof is greater than an electrical resistance value per unit length of the electrically conductive layer 24. Examples of the material forming the electrical resistance layer 23 include a TaN-based material, a TaSiO-based material, a TaSiNO-based material, a TiSiO-based material, a TiSiCO-based material, and an NbSiO-based material. The electrical resistance layer 23 is formed on the heat storage layer 22, with a part thereof lying on the protruding part 22*b*. In this embodiment, in the electrical resistance layer 23 which receives application of voltage from the electrically conductive layer 24, a part thereof which bears no electrically conductive layer 24 thereon acts as the heat generating portion 23*a*.

The heat generating portion 23*a* is a part acting as a heat generating element which generates heat through supply of electric power. The heat generating portion 23*a* is so constituted that a temperature of heat generated through supply of electric power from the electrically conductive layer 24 falls in a range of 200° C. or higher and 550° C. or lower, for example. The heat generating portions 23*a* are situated on the protruding part 22*b* of the heat storage layer 22, and are arranged with substantially equal spacing along the main scanning directions D1 and D2. Moreover, when viewed in a plan view, the heat generating portions 23*a* each have a rectangular shape. Further, the heat generating portions 23*a* are so configured that the respective widths along the main scanning directions D1 and D2 thereof have substantially equal length. Also, the heat generating portions 23*a* are so configured that the respective lengths along the sub-scanning directions D3 and D4 thereof have substantially equal length. As used herein, "substantially equal" is construed as encompassing variation within a generally specified manufacturing tolerance, for example, deviation from the mean of component lengths within a range downwardly from 10%. In this construction, the spacing between the center of one heat generating portion 23*a* and the center of another heat generating portion 23*a* adjacent thereto falls in a range of 5.2 μm or more and 84.7 μm or less, for example.

The electrically conductive layer 24 is disposed, in the form of wiring pattern, on the electrical resistance layer 23. Moreover, the electrically conductive layer 24 comprises a first conductive layer 241, a second conductive layer 242, a third conductive layer 243, and a fourth conductive layer 244. As the material forming the electrically conductive layer 24, one of metals including, for example, aluminum, gold, silver, and copper, or an alloy of these metals can be used.

The first conductive layer 241 acts as control wiring in conjunction with the electrical resistance layer 23 situated toward, of the thickness-wise directions D5 and D6, the direction D6, and is involved in supply of electric power to the heat generating portion 23*a*. The first conductive layers 241 have their one ends connected to corresponding one ends of the heat generating portions 23*a*, respectively, in an electrically independent state.

The second conductive layer 242 has its end electrically connected to the other ends of the plurality of heat generating portions 23*a*, as well as to a power source (not shown). The second conductive layer 242 forms a pair together with the first conductive layer 241 and is involved in supply of electric power to the heat generating portion 23*a*.

The third conductive layer 243 is spaced away from the first conductive layer 241. The third conductive layer 243 has its one end connected to the control IC 26. Also, the third conductive layer 242 has its other end connected to the first electrical connection member 28.

The fourth conductive layer 244 has its one end connected to the temperature measuring element 27. Also, the fourth conductive layer 244 has its other end connected to the first electrical connection member 28.

The protection layer 25 has the function of protecting the heat generating portion 23*a* and the electrically conductive layer 24. The protection layer 25 is so disposed as to cover the heat generating portion 23*a* and a part of the electrically conductive layer 24. Examples of the material forming the protection layer 25 include a diamond-like carbon material, an SiC-based material, an SiN-based material, an SiCN-based material, an SiON-based material, an SiONC-based material, an SiAlON-based material, an $SiO_2$-based material, a $Ta_2O_5$-based material, a TaSiO-based material, a TiC-based material, a TiN-based material, a $TiO_2$-based material, a $TiB_2$-based material, an AlC-based material, an AlN-based material, an $Al_2O_3$-based material, a ZnO-based material, a $B_4C$-based material, and a BN-based material. As used herein, "diamond-like carbon material" refers to a material in which the proportion of carbon atoms (C atoms) having $sp^3$ hybridized orbital is greater than or equal to 1% by atom but less than 100% by atom. Moreover, where the term "-based material" is concerned, for example, an SiC-based material is a material composed of Si atoms and C atoms. It is possible to use not only a material having a stoichiometric composition as a matter of course, but also a material having a composition ratio of departure from the stoichiometric composition.

The control IC 26 has the function of controlling heat generation in the plurality of heat generating portions 23*a*. The control IC 26 is spaced away from the heat generating portion 23*a* in the sub-scanning directions D3 and D4. The control IC 26 is connected to the other ends of the plurality of first conductive layers 241, as well as to one end of the third conductive layer 243. By virtue of this configuration, the control IC 26 is able to exercise heat generation control in a manner to control electric power supplied via the third conductive layer 243 to the heat generating portion 23*a* in a selective manner on the basis of an input driving signal.

The temperature measuring element 27 is involved in measurement of the temperature of the thermal head 10. The temperature measuring element 27 produces output of a temperature signal including information on the temperature of the thermal head 10. For example, a thermistor element and a thermocouple element can be used for the temperature measuring element 27. The thermistor element and the thermocouple element are not limited in form to a chip component, but may be of a conductive film having a part which acts as the element in itself. In this embodiment, a thermistor is adopted for use as the temperature measuring element 27.

The first electrical connection member 28 has the function of carrying out communication of electric signals for driving the heat generating portion 23*a*. For example, a combination of a flexible cable and a connector can be used for the first electrical connection member 28. The first electrical connection member 28 comprises a first electrical wiring part 28*a*, a second electrical wiring part 28*b*, and a third electrical wiring part 28*c*.

The first electrical wiring part 28*a* has its one end connected to the second conductive layer 242, and has its other end connected to a first external connection member 314.

The second electrical wiring part 28*b* is electrically connected to the control IC 26 via the third conductive layer 243. That is, a driving signal from the control IC 26 is supplied to the head substrate 20 via the second electrical wiring part 28*b*.

The third electrical wiring part 28*c* is electrically connected to the temperature measuring element 27 via the fourth conductive layer 244. That is, a temperature signal outputted from the temperature measuring element 27 passes through the third electrical wiring part 28*c* and is then transmitted from the head substrate 20.

Figure 6:
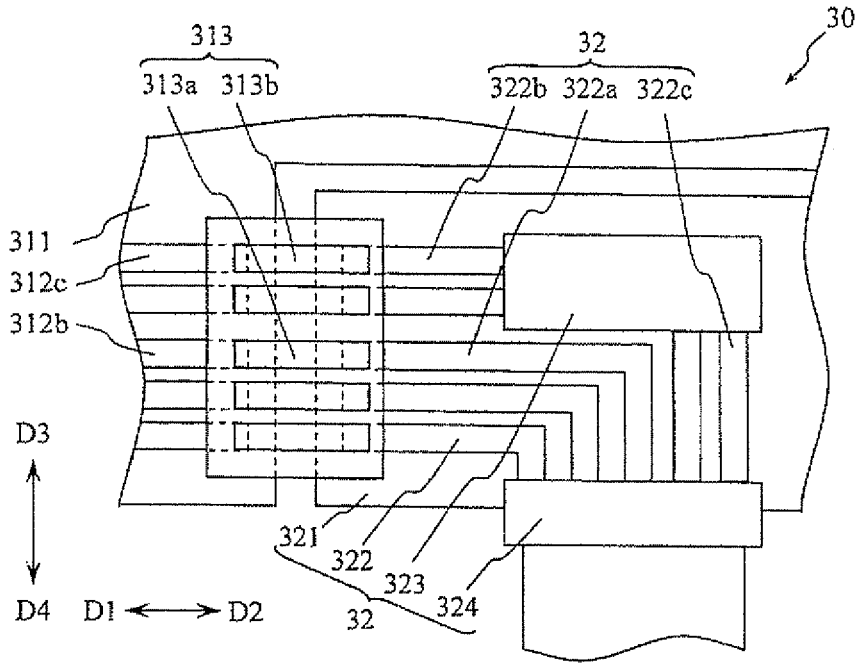
FIG. 6 is an enlarged plan view of the main part of a wiring substrate shown in FIG. 1.

The base substrate 30 comprises a first wiring base substrate 31 and a second wiring base substrate 32 as shown in FIGS. 1, 5 and 6.

The first wiring base substrate 31 comprises a first wiring substrate 311, a first wiring layer 312, a second electrical connection member 313, and a first external connection member 314.

The first wiring substrate 311 has the function of supporting the first wiring layer 312, the second electrical connection member 313, and the first external connection member 324. The first wiring layer 312 provides electrical connection between the first electrical connection member 28 and the second electrical connection member 313 as well as the first external connection member 314. The first wiring layer 312 comprises a first wiring portion 312*a*, a second wiring portion 312*b*, and a third wiring portion 312*c*.

The first wiring portion 312*a* provides connection between the first electrical wiring part 28*a* and the first external connection member 314. The second wiring portion 312*b* provides connection between the second electrical wiring part 28*b* and the second electrical connection member 313. The third wiring portion 312*c* provides connection between the third electrical wiring part 28*c* and the second electrical connection member 313.

The second electrical connection member 313 comprises a fourth electrical wiring part 313*a* and a fifth electrical wiring part 313*b*. For example, a combination of a flexible cable and a connector can be used for the second electrical connection member 313. In this embodiment, a detachable-type connector is adopted for use in the second electrical connection member 313.

The fourth electrical wiring part 313*a* is connected to the second wiring portion 312*b*. The fourth electrical wiring part 313*a* has the function of transmitting a driving signal from the control IC 26 from the second wiring base substrate 32 to the first wiring base substrate 31.

The fifth electrical wiring part 313*b* is connected to the third wiring portion 312*c*. The fifth electrical wiring part 313*b* has the function of transmitting a temperature signal from the temperature measuring element 27 from the third wiring base portion 312*c* to the second wiring base substrate 32.

The first external connection member 314 is involved in supply of electric power to the thermal head 10, and is connected to the power source (not shown). That is, the electric power of the heat generating portion 23*a* is supplied, through the first external connection member 314, to the thermal head 10.

The second wiring base substrate 32 comprises a second wiring substrate 321, a second wiring layer 322, a converter 323, and a second external connection member 324.

The second wiring substrate 321 has the function of supporting the second wiring layer 322, the converter 323, and the second external connection member 324.

The second wiring layer 322 comprises a fourth wiring portion 322*a*, a fifth wiring portion 322*b*, and a sixth wiring portion 322*c*.

The fourth wiring portion 322*a* has its one end connected to the fourth electrical wiring part 313*a*, and has its other end connected to the second external connection member 324. The fifth wiring portion 322*b* has its one end connected to the fifth electrical wiring part 313*b*, and has its other end connected to the converter 323. The sixth wiring portion 322*c* has its one end connected to the converter 323, and has its other end connected to the second external connection member 324.

Figure 7:
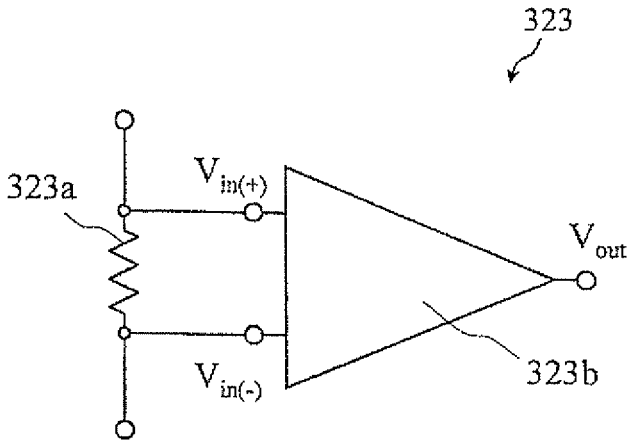
FIG. 7 is a schematic circuit diagram showing the circuit configuration of a converter shown in FIG. 6.

The converter 323 has the function of converting a temperature signal inputted thereto via the fifth wiring portion 322*b* into a control signal which is involved in control of the driving IC 26. As shown in FIG. 7, in this embodiment, the converter 323 includes, for example, resistor 323*a* and an operational amplifier 323*b*, and constitutes a current detection circuit. The resistor 323*a* is electrically connected in series to the thermistor acting as the temperature measuring element 27. Moreover, the operational amplifier 323*b* is so constituted that two input terminals $V_{in(+)}$ and $V_{in(-)}$ are connected with both ends of the resistor 323*a*, respectively. In the operational amplifier 323*b*, an output terminal $V_{out}$ produces output of a voltage standing at a value obtained by multiplying a value, which is obtained by subtracting the voltage inputted to the input terminal $V_{in(-)}$ from the voltage inputted to the input terminal $V_{in(+)}$, by a gain specific to the operational amplifier. In this way, an electric current as a temperature signal flowing through the resistor 323*a* is converted into a voltage as a control signal. The control signal is put out through the second external connection member 324, and is reflected in a driving signal from the driving IC 26.

The second external connection member 324 has the function of providing communication between a control signal as well as driving signal which is involved in control of the driving IC 26 and the exterior thereof.

As shown in FIGS. 1 and 2, the mount substrate 41 has the function of supporting the head substrate 20 and a part of the first wiring base substrate 31 of the wiring substrate 30. On a mount surface 41*a* of the mount substrate 41 are placed the head substrate 20 and a part of the first wiring substrate 311 of the first wiring base substrate 31. The mount substrate 41 of this embodiment comprises a recess 41*b* which is, in contrast to the mount surface 41*a*, depressed in, of the thickness-wise directions D5 and D6, the direction D6. The recess 41*b* is formed in the mount substrate 41 so as to extend from one end to the other end thereof in the main scanning directions D1 and D2, and more specifically from the end situated toward the direction D1 to the end situated toward the direction D2. Examples of the material forming the mount substrate 41 include aluminum, copper, iron, and ceramic materials such as alumina ceramics.

A support plate 42 is interposed between the recess 41*b* of the mount substrate 41 and the second wiring base substrate 32 of the wiring substrate 30. The support plate 42 has the function of supporting the first wiring base substrate 31 in part and the second wiring base substrate 32. That is, on the support plate 42 are placed a part of the first wiring base substrate 31, and the second wiring base substrate 32. The support plate 42 is made of a material which is lower in thermal conductivity than the mount substrate 41. For example, phenolic resin can be used as the material forming the support plate 42.

Figure 8:
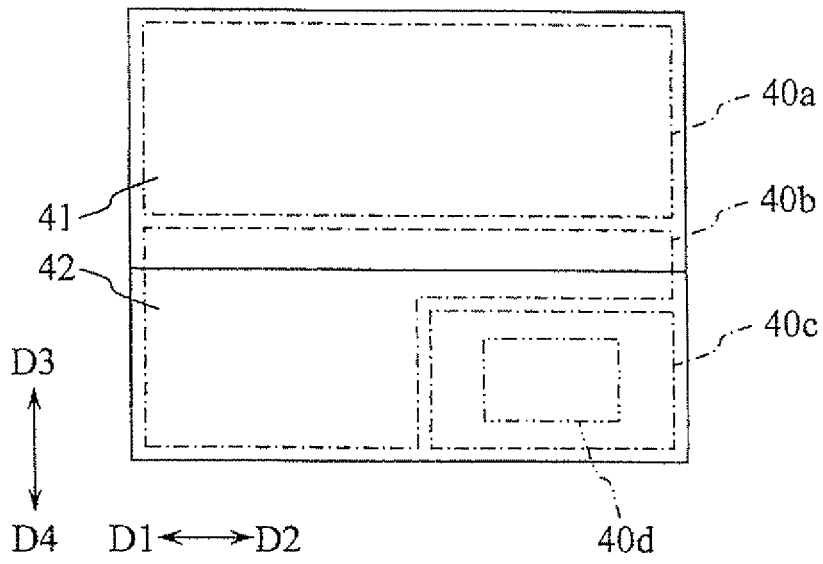
FIG. 8 is an enlarged plan view of the main part of a mount substrate shown in FIG. 1.

As shown in FIG. 8, in the thermal head 10 of this embodiment, the head substrate 20 is placed on a first placement area 40*a* in the mount surface 41 of the mount substrate 41. Moreover, the first wiring base substrate 31 is placed on a second placement area 40*b* straddling the mount substrate 41 and the support plate 42. Further, the second wiring base substrate 32 is placed on a third placement area 40*c* on the support plate 42. That is, the converter 323 placed on the second wiring base substrate 32 is located on the support plate 42. Accordingly, the converter 323 is situated on the support plate 41 placed on the recess 41*b* of the mount substrate 41, whereby the mount substrate 41 is spaced away from a corresponding region at the back surface of the wiring substrate 30 that corresponds to a placement area bearing the converter 323 on the surface of the wiring substrate 30. Note that reference symbol 40*d* shown in FIG. 8 indicates a placement area bearing the converter 323 on the surface of the wiring substrate 30 (hereafter referred to as "the fourth placement area 40*d*").

As described heretofore, the thermal head 10 of this embodiment is constituted to be driven on the basis of a temperature signal, and comprises: the head substrate 20 comprising the substrate 21 and a plurality of heat generating elements 23*a* arranged on the surface of the substrate 21; the wiring substrate 30 comprising, on its surface, the first wiring layer 312 acting as a wiring pattern for transmission of a temperature signal, and the second wiring layer 322; and the mount substrate 41 disposed facing the back surface of the head substrate 20 and the back surface of the wiring substrate 30, and configured to mount the head substrate 20 and the wiring substrate 30. On the surface of the head substrate 20 is placed the control IC 27 (control element) which is electrically connected to the heat generating portion 23*a* acting as the heat generating element and configured to exercise control of driving of the plurality of heat generating portions 23*a*. On the surface of the wiring substrate 30 is placed the converter 323 which is electrically connected to the first wiring layer 312 and the second wiring layer 322 and configured to convert a temperature signal (the first control signal) into a control signal (the second control signal). Moreover, the mount substrate 41 is spaced away from the corresponding region at the back surface of the wiring substrate 30 (more specifically, the second wiring base substrate 32) that corresponds to the fourth placement area 40*d* bearing the converter 323 on the surface of the wiring substrate 30 (more specifically, the second wiring base substrate 32). Accordingly, in the thermal head 10, the corresponding region at the back surface of the wiring substrate 30, which corresponds to the fourth placement area 40*d* bearing the converter 323 on the surface of the wiring substrate 30, is spaced away from the mount substrate 41. This helps reduce transmission of heat generated by the heat generating portion 23*a* through the mount substrate 41 to the converter 323. In consequence, in the thermal head 10, the converter 323 can be operated properly.

Moreover, according to the thermal head 10 of this embodiment, the mount substrate 41 has the recess 41*b* formed in a part thereof which faces the above-described corresponding region at the back surface of the wiring substrate 30. This makes it possible to achieve further reduction in transmission of heat generated by the heat generating portion 23*a* through the mount substrate 41 to the converter 323.

Moreover, according to the thermal head 10 of this embodiment, the recess 41*b* is, in contrast to the mount surface 41*a* which is a part of the mount substrate 41 where the head substrate 20 is placed, depressed in the thickness-wise direction D5, D6. In addition, the support plate 42 made of a material which is lower in thermal conductivity than the mount substrate 41 is disposed in the recess 41*b*. The above-described corresponding region at the back surface of the wiring substrate 30 is located on the mount substrate 41, with the support plate 42 lying between them. This makes it possible to reduce transmission of heat generated by the heat generating portion 23*a* through the mount substrate 41 to the converter 323, as well as to support the second wiring base substrate 32 of the wiring substrate 30 properly.

Moreover, according to the thermal head 10 of this embodiment, there is provided the support plate 42 made of a material which is lower in thermal conductivity than the mount substrate 41, and the above-described corresponding region at the back surface of the wiring substrate 30 is located on the mount substrate 41, with the support plate 42 lying between them. This makes it possible to reduce transmission of heat generated by the heat generating portion 23*a* through the mount substrate 41 to the converter 323, as well as to support the second wiring base substrate 32 properly.

Moreover, according to the thermal head 10 of this embodiment, the wiring substrate 30 comprises the first wiring substrate 31 having the first wiring layer 312 (wiring pattern) and the second wiring substrate 32 bearing the converter 323, and the first wiring substrate 31 and the second wiring substrate 32 are electrically connected to each other via the second electrical connection member 313 (wiring member). This makes it possible to achieve further reduction in heat transmission through the first wiring substrate 31, and thereby operate the converter 323 more satisfactorily.

Moreover, according to the thermal head 10 of this embodiment, the first wiring substrate 31 and the second wiring substrate 32 are electrically connected to each other by the detachable connector. Accordingly, for example, even in a case where the head substrate 20 is shorter in component service life than the converter 323, it is possible to replace the head substrate 20 with another one while keeping using the converter 323.

<Second Embodiment of Thermal Recording Head>

Figure 9:
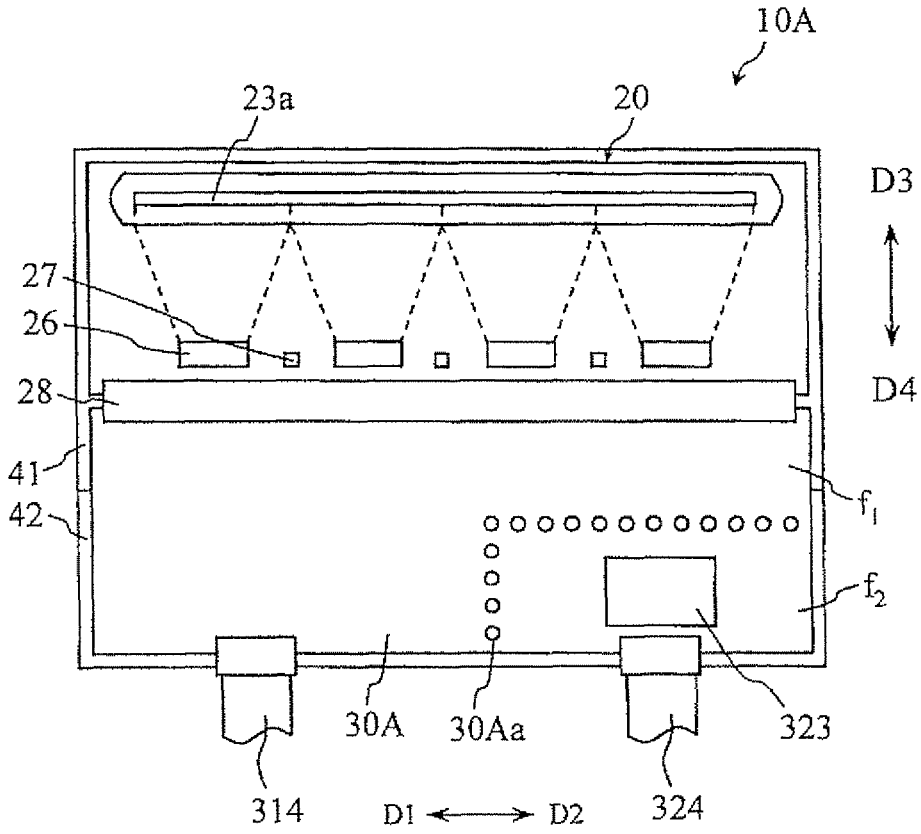
FIG. 9 is a plan view showing a schematic structure of a thermal head which is another embodiment of a thermal recording head according to the invention.

A thermal head 10A which is another embodiment of the thermal recording head according to the invention shown in FIG. 9 differs from the thermal head 10 in that a wiring substrate 30A is provided instead of the wiring substrate 30. Otherwise, the thermal head 10A is similar in configuration to the thermal head 10 thus far described.

The wiring substrate 30A includes a first wiring region $f_1$ instead of the first wiring substrate 31, and also includes a second wiring region $f_2$ instead of the second wiring substrate 32. In the wiring substrate 30A, a plurality of through holes 30Aa are arranged between the first placement region $f_1$ and the second placement region $f_2$. That is, in the wiring substrate 30A, the through holes 30Aa are so arranged as to surround the second placement region $f_2$. Moreover, the wiring substrate 30A is brought into conduction via wiring installed between the through holes 30Aa.

According to the thermal head 10A of this embodiment, in the wiring substrate 30A, the plurality of through holes 30Aa are so arranged as to surround the second wiring region $f_2$ including the converter 323. This makes it possible to reduce heat transmission through the wiring substrate 30A, and thereby operate the converter 323 more satisfactorily.

<Third Embodiment of Thermal Recording Head>

Figure 10:
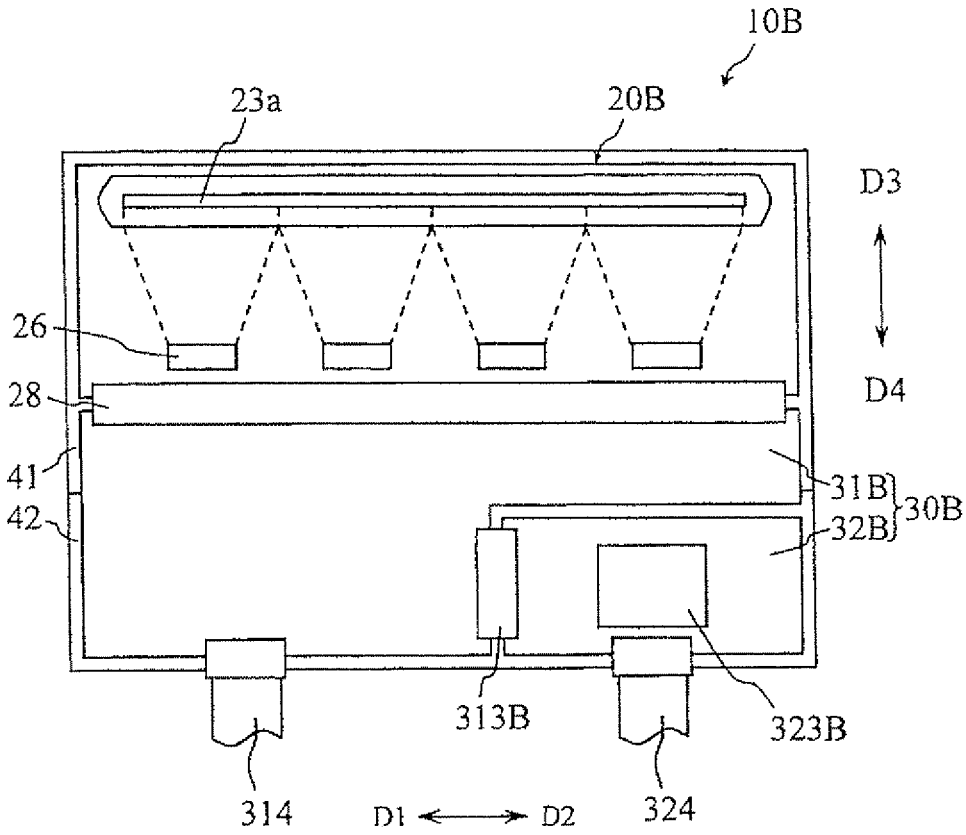
FIG. 10 is a plan view showing a schematic structure of a thermal head which is another embodiment of a thermal recording head according to the invention.

A thermal head 10B which is another embodiment of the thermal recording head according to the invention shown in FIG. 10 differs from the thermal head 10 in that a head substrate 20B is provided instead of the head substrate 20, and in that a wiring substrate 30B is provided instead of the wiring substrate 30. Otherwise, the thermal head 10B is similar in configuration to the thermal head 10 as described previously.

The head substrate 20B differs from the head substrate 20 in that the temperature measuring element 27 and the fourth conductive layer 244 are omitted. Otherwise, the head substrate 20B is similar in configuration to the head substrate 20 as described previously.

Figure 11:
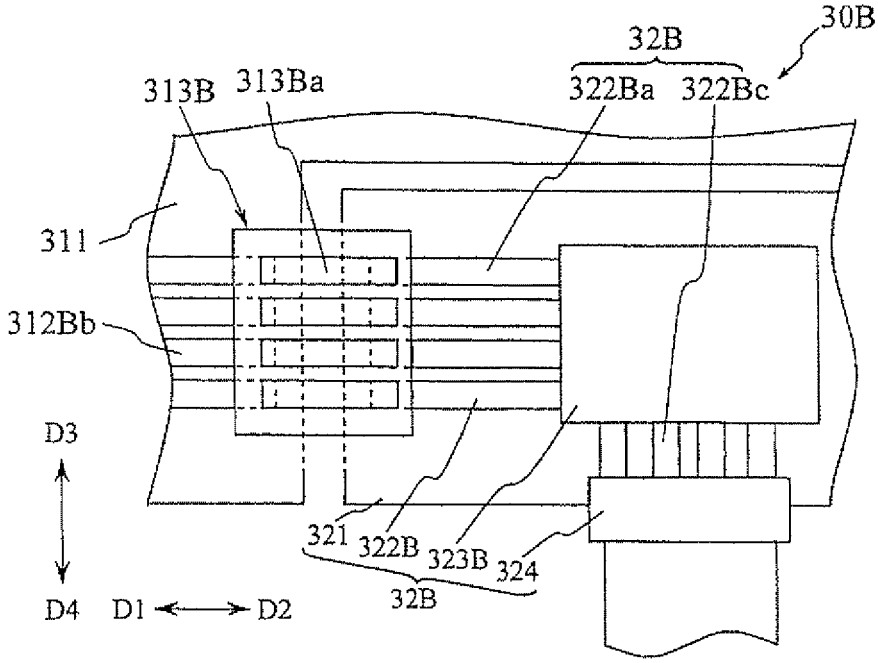
FIG. 11 is an enlarged plan view of the main part of a wiring substrate shown in FIG. 10.

As shown in FIGS. 10 and 11, the wiring substrate 30B comprises a first wiring base substrate 31B and a second wiring base substrate 32B.

The first wiring base substrate 31B differs from the first wiring base substrate 31 in that the third wiring portion 312*c* and the fifth electrical wiring part 313*b* are omitted. Otherwise, the first wiring base substrate 31B is similar in configuration to the first wiring base substrate 31 as described earlier.

The second wiring base substrate 328 comprises a second wiring substrate 321, a second wiring layer 322B, a converter 323B, and a second external connection member 324. The second wiring substrate 321 and the second external connection member 324 are similar in configuration to those as described earlier.

The second wiring layer 322B comprises a fourth wiring portion 322Ba and a sixth wiring portion 322Bc.

The fourth wiring portion 322Ba has its one end connected to a fourth electrical wiring part 313Ba, and has its other end connected to the converter 323B.

The sixth wiring portion 322Bc has its one end connected to the converter 323B, and has its other end connected to the second external connection member 324.

The converter 323B has the function of effecting signal conversion in a manner to convert a second control signal which is inputted thereto via a sixth wiring portion 322Bc into a driving signal which is involved in control of the driving IC 26. Examples of the second control signal include a USB signal according to the Universal Serial Bus (hereafter referred to simply as "USB") standard and a LVDS signal obtained by the low voltage differential signal processing according to the TIA/EIA-644 standard which is standard 644 of Telecommunications Industry Association/Electronic Industries Alliance (TIA/EIA). In this embodiment, the converter 323B includes an analog-digital converter.

The thermal head 103 is driven on the basis of a driving signal. Just as with the thermal head 10 of the first embodiment, in the thermal head 10B, the corresponding region at the back surface of the wiring substrate 30, which corresponds to the fourth placement area 40*d* bearing the converter 323 on the surface of the wiring substrate 30, is spaced away from the mount substrate 41. This helps reduce transmission of heat generated by the heat generating portion 23*a* through the mount substrate 41 to the converter 323B. In consequence, also in the thermal head 10B, the converter 323B can be operated properly.

<Thermal Recording Apparatus>

Figure 12:
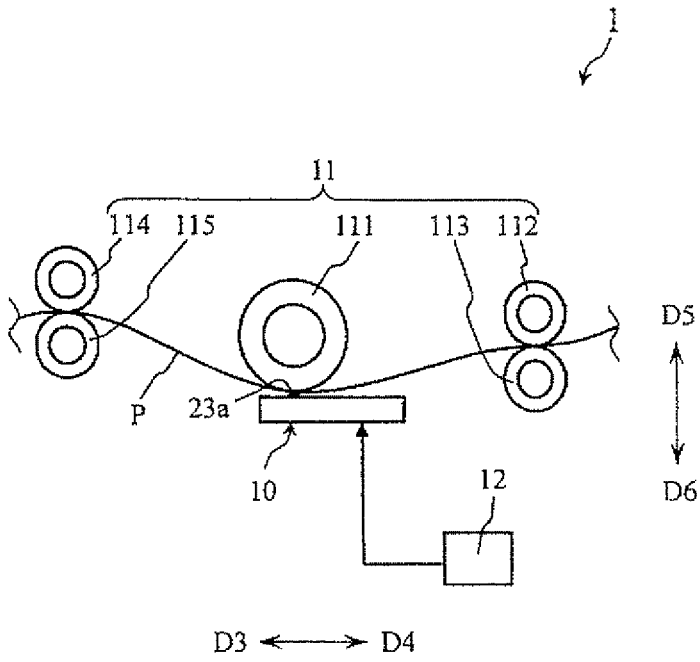
FIG. 12 is a diagram showing a schematic structure of a thermal printer which is an embodiment of a thermal recording apparatus according to the invention.

FIG. 12 is a diagram showing a schematic structure of a thermal printer 1 which is an embodiment of a thermal recording apparatus according to the invention.

The thermal printer 1 comprises the thermal head 10, a conveyance mechanism 11, and a control mechanism 12.

The conveyance mechanism 11 has the function of conveying a recording medium P in, of the sub-scanning directions D3 and D4, the direction D3, while bringing the recording medium P into contact with the protection layer 25 situated on the heat generating portion 23*a* of the thermal head 10. The conveyance mechanism 11 comprises a platen roller 111 and conveying rollers 112, 113, 114, and 115.

The platen roller 111 has the function of pressing the recording medium P against the heat generating portion 23*a*. The platen roller 111 is rotatably supported in contact with the protection layer 25 situated on the heat generating portion 23*a*. The platen roller 111 is constructed by covering the outer surface of a cylindrical base body with an elastic member. The base body is made of a metal such for example as stainless steel. The elastic member is made for example of butadiene rubber having a thickness in a range of 3 [mm] or more and 15 [mm] or less.

The conveying rollers 112, 113, 114, and 115 have the function of conveying the recording medium P. That is, the conveying rollers 112, 113, 114, and 115 act to feed the recording medium P to the region between the heat generating portion 23*a* of the thermal head 10 and the platen roller 111, as well as to pull the recording medium P out of the region between the heat generating portion 23*a* of the thermal head 10 and the platen roller 111. The conveying rollers 112, 113, 114, and 115 may be formed of a metal-made cylindrical member. For example, just like the platen roller 111, each roller may be constructed by covering the outer surface of a cylindrical base body with an elastic member.

The control mechanism 12 has the function of receiving a control signal from the second external connection member 324 and feeding a driving signal to the control IC 26.

The thermal printer 1 comprises the thermal head 10 and the control mechanism 12 configured to allow control signal communication with the converter 323, and is therefore able to exploit the advantageous effects of the thermal head 10. Accordingly, the thermal printer 1 can operate the converter 323 properly and control the thermal head 10 properly.

While several embodiments of the invention has been illustrated, it is to be understood that the invention is not so limited but is susceptible of various changes and modifications without departing from the gist of the invention.

While, in the above embodiments, there is described the thermal head 10 as an example of the thermal recording head, the application of the invention is not limited to the thermal head. For example, the structure of the invention is applicable to an ink-jet head. Also in this case, similar effects can be achieved.

In the above embodiments, there are described a temperature signal and a driving signal as examples of the first control signal, and a voltage signal, a USB signal, and the like containing temperature information as examples of the second control signal. However, the first and second control signals are not so limited. As the first control signal, various electric signals within the range of the thermal recording head can be used so long as they are involved directly or indirectly in driving control of the heat generating elements. In addition, as the second control signal, various signals for use in transmission to or reception from the thermal recording apparatus can be used.

In the above embodiments, the first conductive layer 241 acts as control wiring in conjunction with the electrical resistance layer 23 situated toward, of the thickness-wise directions D5 and D6, the direction D6. However, the first conductive layer 241 is not so limited but may be configured to function as control wiring by itself.

Figure 13:
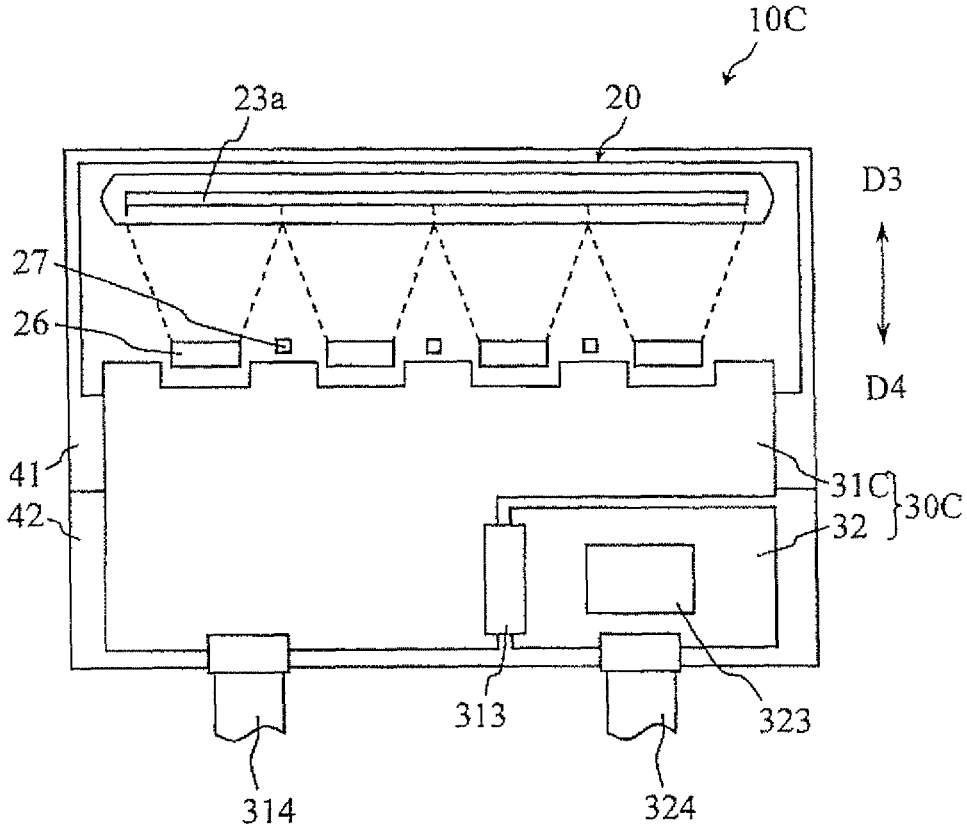
FIG. 13 is a diagram showing an example of modified form of the embodiment of the thermal recording head according to the invention.

While, in the above embodiments, the first electrical connection member 28 is constructed as a single component, it is not so limited but may comprise, for example, a bonding wire acting as electrical wiring and a protection member. Moreover, as shown in FIG. 13, the first electrical connection member 28 may be configured as a part of the first wiring base substrate 31C.

While, in the above embodiments, the second wiring base substrate 32 is placed on the top surface of the support plate 42 situated toward, of the thickness-wise directions D5 and D6, the direction D5, it is not so limited but may be placed for example on one of the side surfaces of the mount substrate 41 situated toward, of the sub-scanning directions D3 and D4, the direction D4, through the support plate 42.

Figure 14:
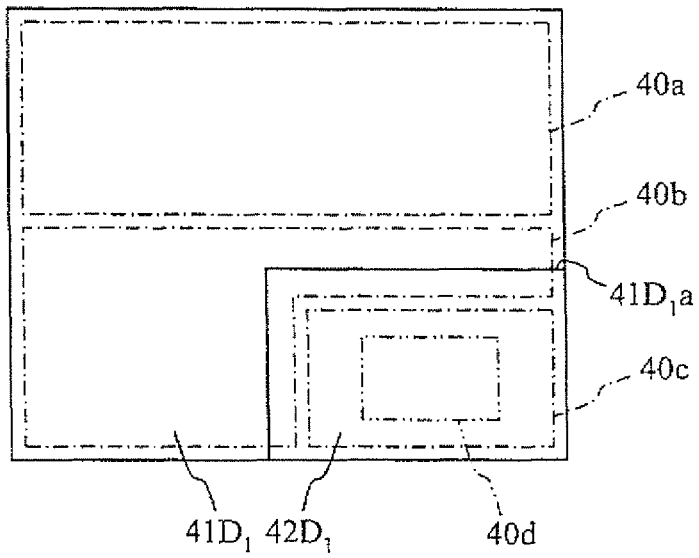
FIG. 14 is a diagram showing an example of modified form of the mount substrate shown in FIG. 8.
Figure 15:
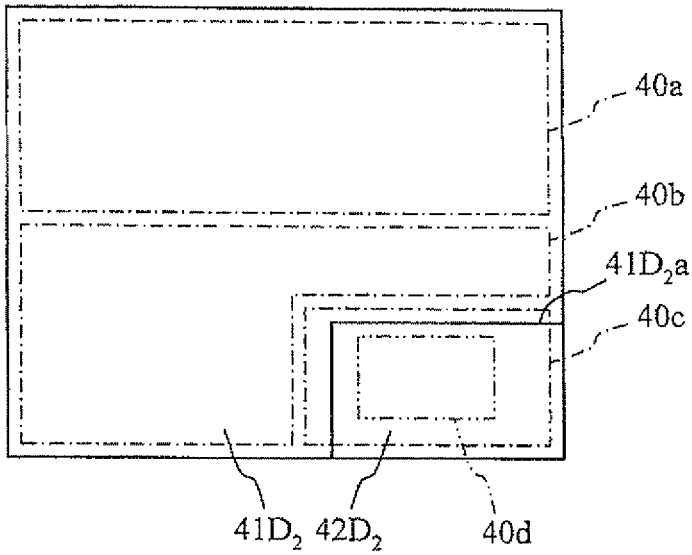
FIG. 15 is a diagram showing an example of modified form of the mount substrate shown in FIG. 8.
Figure 16:
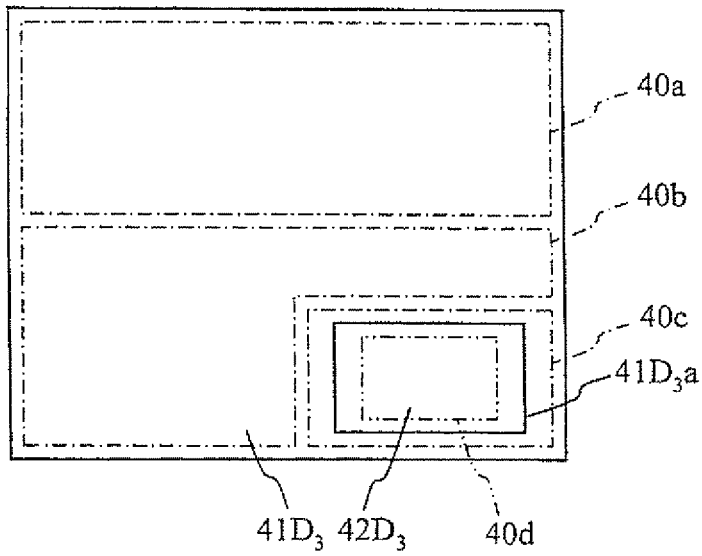
FIG. 16 is a diagram showing an example of modified form of the mount substrate shown in FIG. 8.
Figure 17:
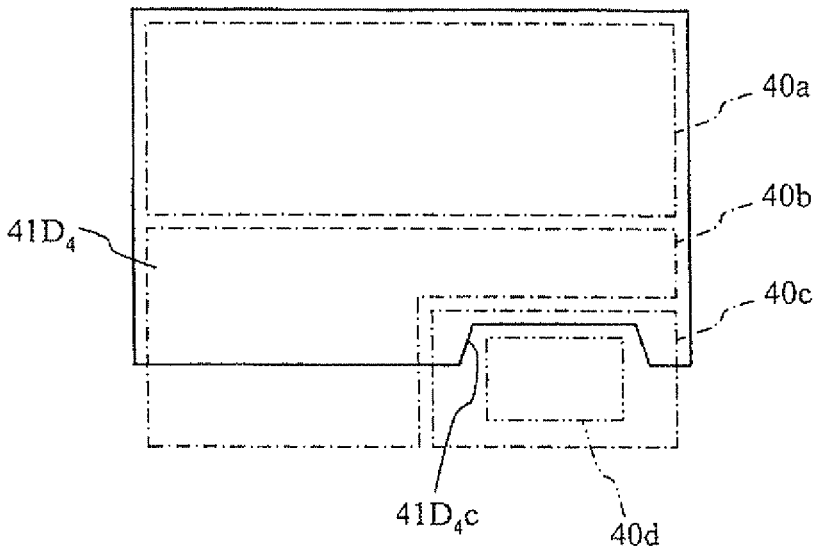
FIG. 17 is a diagram showing an example of modified form of the mount substrate shown in FIG. 8.
Figure 18:
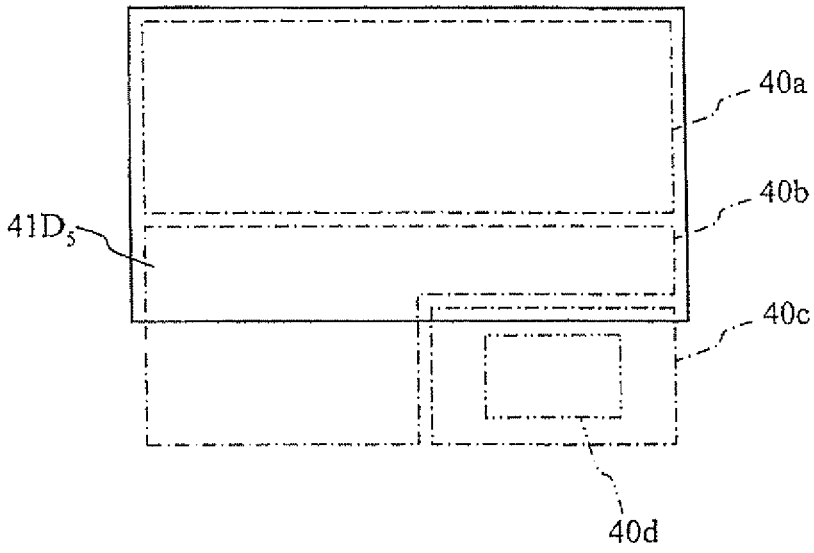
FIG. 18 is a diagram showing an example of modified form of the mount substrate shown in FIG. 8.

The mount substrate 41 is not limited to that as described in the above embodiments. For example, as shown in FIG. 14, in a mount substrate 41$D_1$, a recess 40$D_1$a is not formed so as to extend across the ends of the mount substrate 41$D_1$ in the main scanning directions D1 and D2. As another alternative, as shown in FIG. 15, in a mount substrate 41$D_2$, a third placement area 40*c* of a second wiring base substrate 32D is so located as to straddle the mount substrate 41$D_2$ and a support plate 42$D_2$. As still another alternative, as shown in FIG. 16, a recess 40$D_3$a is so formed as to surround the fourth placement area 40*d*. As yet another alternative, as shown in FIG. 17, a mount substrate 41$D_4$ has a recess 41$D_4$c depressed in, of the sub-scanning directions D3 and D4, the direction D3. As yet a further alternative, as shown in FIG. 18, a mount substrate 41$D_5$ is disposed close to the fourth placement area 40*d* for the placement of a part of the second wiring base substrate 32D.

Although, in the embodiments, a bonding member for use in the placement of the head substrate 20 and the wiring substrate 30 on the mount substrate 41 is omitted, as is normal, the bonding member is used. Moreover, instead of the bonding member, it is possible to use for example a hook-and-loop fastener or a double-faced tape having a base made of a shock-absorbing material such as a resin foam.

REFERENCE SIGNS LIST

1: Thermal printer (Thermal recording apparatus)
10: Thermal head (Thermal recording head)
11: Conveyance mechanism
111: Platen roller
112, 113, 114, 115: Conveying roller
12: Control mechanism
20: Head substrate
21: Substrate
22: Heat storage layer
22*a*: Base part
22*b*: Protruding part
23: Electrical resistance layer
23*a*: Heat generating portion (Heat generating element)
24: Electrically conductive layer

241: First conductive layer (Control wiring)
242: Second conductive layer
243: Third conductive layer
25: Protection layer
26: Control IC (Control element)
27: Temperature measuring element
28: First electrical connection member
28*a*: First electrical wiring part
28*b*: Second electrical wiring part
28*c*: Third electrical wiring part
30: Base substrate
30*a*: Through hole 30*a*
31: First wiring base substrate
311: First wiring substrate
311*a*: Through hole
312: First wiring layer (Wiring pattern)
312*a*: First wiring portion
312*b*: Second wiring portion
312*c*: Third wiring portion
313: Second electrical connection member
313*a*: Fourth electrical wiring part
313*b*: Fifth electrical wiring part
314: First external connection member
32: Second wiring base substrate
321: Second wiring substrate
322: Second wiring layer (Wiring pattern)
322*a*: Fourth wiring portion
322*b*: Fifth wiring portion
322*c*: Sixth wiring portion
323: Converter
323*a*: Resistor
323*b*: Operational amplifier
324: Second external connection member
40*a*: First placement area in the head substrate
40*b*: Second placement area in the first wiring substrate
40*c*: Third placement area in the second wiring substrate
40*d*: Fourth placement area in the converter (Placement Area)
41: Mount substrate
41*a*: Mount surface
41*b*: Recess
42: Support plate
P: Recording medium
$f_1$: First wiring region
$f_2$: Second wiring region

The invention claimed is:

1. A thermal recording head constituted to be driven on a basis of a first control signal, comprising:

a head substrate comprising a substrate and a plurality of heat generating elements arranged on a surface of the substrate;

a wiring substrate comprising a wiring pattern provided on a surface of the wiring substrate; and a mount substrate disposed facing a back surface of the head substrate and a back surface of the wiring substrate and configured to mount the head substrate and the wiring substrate, on the surface of the head substrate or on the surface of the wiring substrate being placed a control element electrically connected to the heat generating elements and configured to control driving of the plurality of heat generating elements, on the surface of the wiring substrate being placed a converter electrically connected to the wiring pattern and configured to convert the first control signal into a second control signal, and the mount substrate being spaced away from a corresponding region at the back surface of the wiring substrate that corresponds to a placement area bearing the converter on the surface of the wiring substrate.

2. The thermal recording head according to claim 1, wherein the mount substrate comprises a recess formed in a part thereof which faces the corresponding region of the wiring substrate.

3. The thermal recording head according to claim 2, wherein the recess is relative to a part of the mount substrate on which is placed the head substrate, wherein a support plate made of a material which is lower in thermal conductivity than the mount substrate is disposed in the recess, and wherein the corresponding region of the wiring substrate is located on the mount substrate, with the support plate lying between them.

4. The thermal recording head according to claim 1, further comprising a support plate made of a material which is lower in thermal conductivity than the mount substrate, wherein the corresponding region of the wiring substrate is located on the mount substrate, with the support plate lying between them.

5. The thermal recording head according to claim 1, wherein the wiring substrate comprises a plurality of through holes arranged so as to surround the placement area.

6. The thermal recording head according to claim 1, wherein the wiring substrate comprises a first wiring substrate comprising the wiring pattern and a second wiring substrate bearing the converter, and wherein the first wiring substrate and the second wiring substrate are electrically connected to each other via a wiring member.

7. A thermal recording apparatus, comprising:

the thermal recording head according to claim 1;

a conveyance mechanism configured to convey a recording medium on the heat generating elements; and a control mechanism configured to allow transmission or reception of the second control signal relative to the converter.

* * * * *